US011542680B2

(12) United States Patent
Kihara et al.

(10) Patent No.: US 11,542,680 B2
(45) Date of Patent: Jan. 3, 2023

(54) ELECTRIC CONSTRUCTION MACHINE

(71) Applicant: Hitachi Construction Machinery Tierra Co., Ltd., Koka (JP)

(72) Inventors: Seiichi Kihara, Koka (JP); Kiwamu Takahashi, Moriyama (JP); Takeshi Ishii, Shiga (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 0 days.

(21) Appl. No.: 17/272,980

(22) PCT Filed: Jan. 29, 2020

(86) PCT No.: PCT/JP2020/003164
§ 371 (c)(1),
(2) Date: Mar. 3, 2021

(87) PCT Pub. No.: WO2020/183959
PCT Pub. Date: Sep. 17, 2020

(65) Prior Publication Data

US 2021/0254305 A1 Aug. 19, 2021

(30) Foreign Application Priority Data

Mar. 13, 2019 (JP) ..... JP2019-045483

(51) Int. Cl.
*E02F 9/08* (2006.01)
*E02F 9/18* (2006.01)

(52) U.S. Cl.
CPC ..... *E02F 9/0858* (2013.01); *E02F 9/18* (2013.01)

(58) Field of Classification Search
CPC ..... E02F 9/0858; E02F 9/18
(Continued)

(56) References Cited

U.S. PATENT DOCUMENTS 6,315,500 B1 11/2001 Goodman et al.
6,346,004 B1 * 2/2002 Daoud ..... H01R 4/2433 439/409
2004/0195469 A1 * 10/2004 Kondo ..... F16M 11/14 381/363
2010/0073479 A1 3/2010 Uto et al.
2011/0073362 A1 * 3/2011 Shimizu ..... H02S 40/34 174/520

(Continued)

FOREIGN PATENT DOCUMENTS

EP 2 840 188 B1 5/2017
JP 61-75794 A 4/1986

(Continued)

OTHER PUBLICATIONS

International Search Report (PCT/ISA/210) issued in PCT Application No. PCT/JP2020/003164 dated Apr. 7, 2020 with English translation (four (4) pages).

(Continued)

*Primary Examiner* — Joseph G Ustaris
*Assistant Examiner* — Matthew David Kim
(74) *Attorney, Agent, or Firm* — Crowell & Moring LLP

(57) ABSTRACT

An electric hydraulic excavator (1) includes an automotive lower traveling structure (2) and
an upper revolving structure (3) mounted on the lower traveling structure (2) to be capable of revolving thereto. The upper revolving structure (3) includes a revolving frame (5) as a base, a counterweight (13) disposed on a rear side of the revolving frame (5), and an electric power source (9) that is positioned on a front side of the counterweight (13) to be mounted on the revolving frame (5) and is power-fed from an external electric current source. The counterweight (13) is provided with a cable insertion hole (16) as disposed therein. A power feeding cable (12) is inserted in the cable
(Continued)

insertion hole (16) for connection between the external electric current source and the electric power source (9).

6 Claims, 8 Drawing Sheets

(58) Field of Classification Search
USPC ..... 348/148
See application file for complete search history.

(56) References Cited

U.S. PATENT DOCUMENTS

| | | | | |
|---|---|---|---|---|
| 2013/0061424 | A1 | 3/2013 | Lee | |
| 2014/0000975 | A1* | 1/2014 | Ueda | H01M 10/613 180/291 |
| 2015/0303423 | A1* | 10/2015 | Okuyama | B66F 9/24 187/233 |
| 2018/0038077 | A1* | 2/2018 | Nomura | E02F 9/2004 |
| 2019/0143819 | A1* | 5/2019 | Laaksonen | B60L 53/12 307/9.1 |

FOREIGN PATENT DOCUMENTS

| | | | | |
|---|---|---|---|---|
| JP | 2006-161306 | A | | 6/2006 |
| JP | 2007-16488 | A | | 1/2007 |
| JP | 2008-184789 | A | | 8/2008 |
| JP | 2010-65445 | A | | 3/2010 |
| JP | 2014-181513 | A | | 9/2014 |
| KR | 10-2006-0063666 | A | | 6/2006 |
| KR | 20-2010-0003973 | U | | 4/2010 |
| KR | 2010003973 | U | * | 4/2010 |
| KR | 10-2013-0095628 | A | | 8/2013 |

OTHER PUBLICATIONS

Japanese-language Written Opinion (PCT/ISA/237) issued in PCT Application No. PCT/JP2020/003164 dated Apr. 7, 2020 (three (3) pages).

Korean-language Office Action issued in Korean Application No. 10-2021-7004901 dated Jul. 18, 2022 with English translation (10 pages).

Extended European Search Report issued in corresponding European Application No. 20769395.3 dated Nov. 9, 2022 (8 pages).

* cited by examiner

ELECTRIC CONSTRUCTION MACHINE

TECHNICAL FIELD

The present invention relates to an electric construction machine that is provided with an electric motor thereon, such as an electric hydraulic excavator.

BACKGROUND ART

A hydraulic excavator representative of a construction machine is provided with an automotive lower travelling structure, an upper revolving structure mounted on the lower travelling structure to be capable of revolving thereto. A vehicle body of the hydraulic excavator is configured with the lower traveling structure and the upper revolving structure. A working mechanism thereof is mounted on a front side of the upper revolving structure to be capable of lifting and tilting thereto and performs an excavating operation and the like. Here, there is known an electric hydraulic excavator that operates the vehicle body and the working mechanism by driving a hydraulic pump by an electric motor.

Among the electric hydraulic excavators, there is an electric hydraulic excavator that is provided with an electric motor and a motor control unit as an electric power source and drives the electric motor by electric power supplied from an external electric current source. On the other hand, there is an electric hydraulic excavator that is provided with an electric motor, a motor control unit, a battery and a battery charger as an electric power source and drives the electric motor by electric power from the battery. In this case, in the electric hydraulic excavator provided with the electric motor and the motor control unit as the electric power source, the external electric current source and the motor control unit are all the time connected by a power feeding cable. On the other hand, in the electric hydraulic excavator provided with the electric motor, the motor control unit, the battery and the battery charger as the electric power source, the external electric current source and the battery charger are all the time connected by a power feeding cable. In this way, in the electric hydraulic excavator the electric power source mounted on the vehicle body and the external electric current source are all the time connected by the power feeding cable.

Here, there is proposed an electric hydraulic excavator provided with a cable arm for holding the power feeding cable, as the electric hydraulic excavator connecting the electric power source and the external electric current source. In this electric hydraulic excavator, the cable arm is attached at its base end portion to a housing cover disposed on a front side of a counterweight to be rotatable through a bearing thereto. The power feeding cable passes above the counterweight in a state of being held by the cable arm. Then, the power feeding cable is inserted through a cable insertion hole formed in the housing cover into the housing cover and is connected to the electric power source accommodated in the housing cover (Patent Document 1).

PRIOR ART DOCUMENT

Patent Document

Patent Document 1: Japanese Patent Laid-Open No. 2010-65445 A

SUMMARY OF THE INVENTION

In the electric hydraulic excavator according to Patent Document 1, however, for example, in a case where at the revolving operation of the upper revolving structure, the housing cover makes contact with obstacles in the surrounding thereof to be damaged and deformed, there is a possibility that the power feeding cable inserted into the housing cover is also damaged. In addition, in a case where dropping objects or flying objects collide with the housing cover at the excavating operation, causing the housing cover to be damaged and deformed, there is a possibility that the power feeding cable inserted into the housing cover is also damaged.

In addition, the power feeding cable acts as a source of generating electrical noises. Therefore, it is necessary to take measures (EMC measure) of suppressing noises from the power feeding cable from giving an adverse effect on various kinds of electric devices accommodated in the housing cover. On the other hand, for example, it is necessary to provide the power feeding cable with a dedicated shield member for shielding the surrounding electric devices from noises generating from the power feeding cable. As a result, there is posed a problem of increasing the number of components.

According to an aspect of the present invention, an object of the present invention is to provide an electric construction machine that can protect a power feeding cable for connection between an external electric current source and an electric power source.

An aspect of the present invention is applied to an electric construction machine comprising an automotive lower traveling structure, and an upper revolving structure mounted on the lower traveling structure to be capable of revolving thereto, the upper revolving structure including a revolving frame as a base, a counterweight disposed on a rear side of the revolving frame, and an electric power source that is positioned on a front side of the counterweight to be mounted on the revolving frame and is power-fed from an external electric current source.

The aspect of the present invention is characterized in that the counterweight is provided with a cable insertion hole formed therein for insertion of a power feeding cable for connection between the external electric current source and the electric power source.

According to the aspect of the present invention, the cable insertion hole is formed in the counterweight composed of a rigid heavy object. Therefore, for example, even in a case where the counterweight makes contact with the surrounding obstacle or in a case where the dropping object or the flying object collides with the counterweight, the power feeding cable inserted in the cable insertion hole can be protected therefrom. In addition, in a case where the cable insertion hole is disposed in the counterweight formed of metallic material, by surrounding the power feeding cable by the cable insertion hole, it is possible to shield the surrounding electric devices from electrical noises generating from the power feeding cable.

MODE FOR CARRYING OUT THE INVENTION

Figure 1:
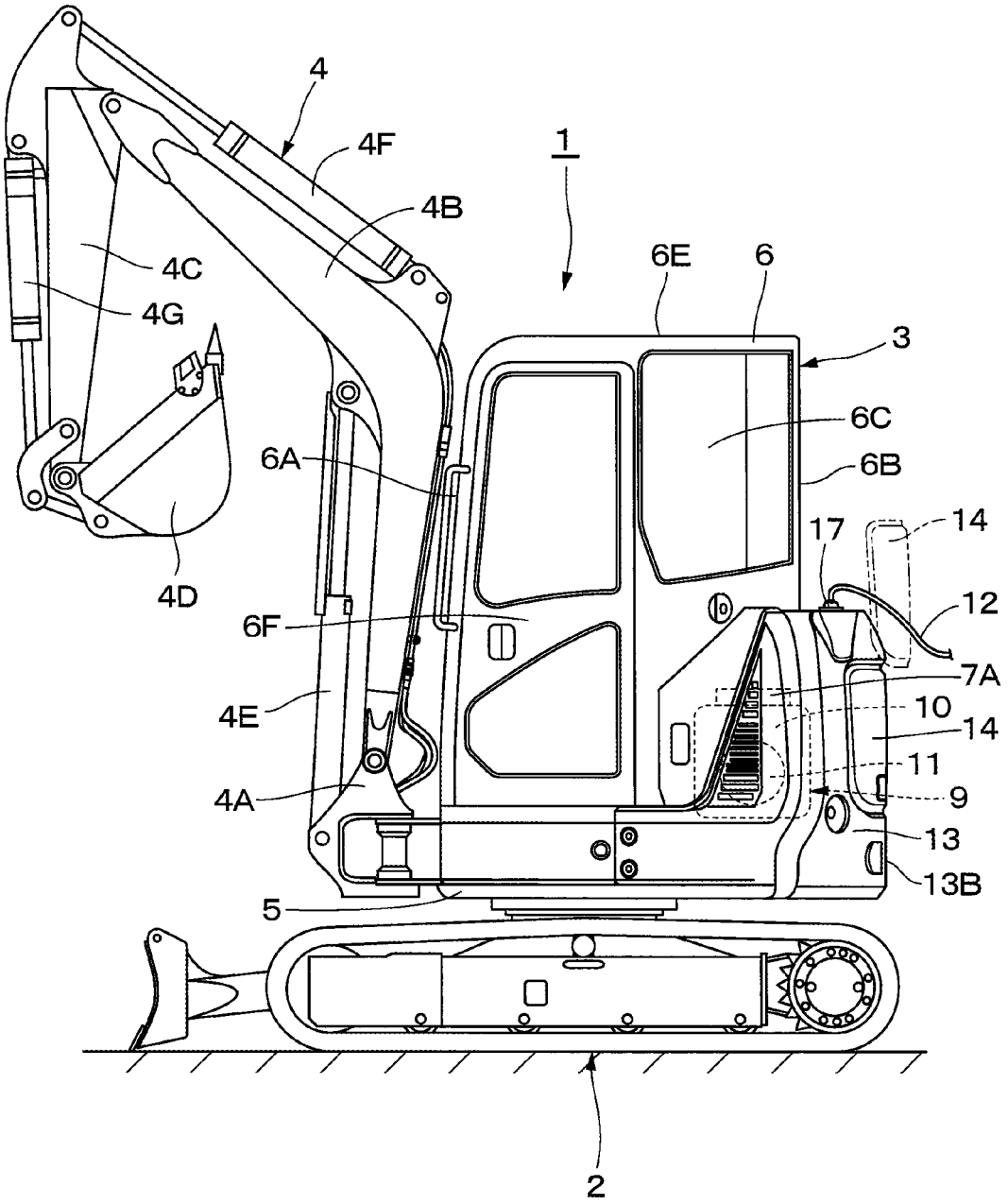
FIG. 1 is a front view showing an electric hydraulic excavator according to a first embodiment of the present invention.

Hereinafter, embodiments of the present invention will be in detail explained referring to the accompanying drawings by taking a case of being applied to an electric hydraulic excavator as an example. It should be noted that the embodiments will be explained by defining a traveling direction of the hydraulic excavator as a front-back direction and a direction perpendicular to the traveling direction of the hydraulic excavator as a left-right direction.

FIG. 1 to FIG. 4 show a first embodiment of the present invention. An electric hydraulic excavator 1 representative of an electric construction machine is configured by a crawler type of an automotive lower traveling structure 2 in the front-back direction, an upper revolving structure 3 that is mounted on the lower traveling structure 2 to be capable of revolving thereto, and a working mechanism 4 that is disposed on a front side of the upper revolving structure 3. The lower traveling structure 2 and the upper revolving structure 3 configure a vehicle body of the hydraulic excavator 1. The hydraulic excavator 1 travels in a working site by the lower traveling structure 2, and performs an excavating operation of sand and earth, and the like by performing a lifting/tilting operation of the working mechanism 4 while revolving the upper revolving structure 3.

Here, the hydraulic excavator 1 is provided thereon with an electric power source 9 including an after-mentioned electric motor 10. The hydraulic excavator 1 is configured to operate by supply of electric power through an after-mentioned power feeding cable 12 from an external electric current source (not shown) to the electric power source 9 in the hydraulic excavator 1.

The working mechanism 4 is provided with a swing post 4A attached on a front end of a revolving frame 5 to be capable of swinging thereto in the left-right direction, a boom 4B attached on the swing post 4A to be capable of lifting/tilting thereto, an arm 4C attached on a tip end of the boom 4B to be rotatable thereto, and a bucket 4D attached on a tip end of the arm 4C to be rotatable thereto. The boom 4B, the arm 4C and the bucket 4D are respectively driven by a boom cylinder 4E, an arm cylinder 4F, and a bucket cylinder 4G. A swing cylinder (not shown) is disposed between the revolving frame 5 and the swing post 4A to swing the swing post 4A in the left-right direction.

The upper revolving structure 3 includes the revolving frame 5 as a base that is attached on the lower traveling structure 2 to be capable of revolving thereto, a cab 6, a housing cover 7, the electric power source 9 and a counterweight 13, which are arranged on the revolving frame 5 and will be described later.

The cab 6 as an operator's room is disposed in a front left side of the revolving frame 5 for an operator to get in. The cab 6 is provided therein with an operator's seat, control lever units for traveling and working, and the like (none of them is shown). The cab 6 is surrounded by a front surface portion 6A, a rear surface portion 6B, a left surface portion 6C, a right surface portion 6D and a top surface portion 6E to be formed in a vertically long box shape. A door 6F is attached on the left surface portion 6C of the cab 6, and the operator opens/closes the door 6F to get in/out of the cab 6.

The housing cover 7 is positioned on the front side of the counterweight 13 to be disposed on the revolving frame 5. The housing cover 7 includes a left cover 7A and a right cover 7B. The left cover 7A rises upward from a rear left side of the revolving frame 5 and extends from the left end portion of the counterweight 13 toward the left surface portion 6C of the cab 6. The right cover 7B rises upward from a rear right side of the revolving frame 5 and extends from the right end portion of the counterweight 13 toward the forward side. The housing cover 7 and the counterweight 13 define a machine room 8 on the revolving frame 5. The machine room 8 accommodates therein mount devices such as the electric power source 9, the hydraulic pump 11, and a control valve (not shown), which will be described later, and the like.

The electric power source 9 is positioned on the front side of the counterweight 13 to be mounted on the revolving frame 5 and is accommodated in the machine room 8 surrounded by the housing cover 7 and the counterweight 13. The electric power source 9 includes the electric motor 10, a motor control unit (not shown) for controlling an operation of the electric motor 10, and the like. The electric motor 10 is composed of, for example, a three-phase induction motor and the like. Electric power is supplied (fed) to electric motor 10 from an external electric current source (not shown) such as a commercial electric current source supplying three-phase AC power through the after-mentioned power feeding cable 12. Thereby. The electric motor 10 is rotated to drive the hydraulic pump 11. In this case, operation control (power feeding control) of the electric motor 10 is performed by the motor control unit.

The hydraulic pump 11 is connected to an output shaft of the electric motor 10. The hydraulic pump 11 is driven by the electric motor 10 to pressurize hydraulic oil reserved in a hydraulic oil tank (not shown). Thereby, the hydraulic pump 11 delivers pressurized oil toward a hydraulic motor for traveling and a hydraulic motor for revolving (none of them is shown), which are mounted on the hydraulic excavator 1, and various kinds of cylinders 4E, 4F, 4G and the like, which are arranged on the working mechanism 4.

The power feeding cable 12 establishes electrical connection between the external electrical current source (not shown) and the electric power source 9. The power feeding cable 12 has one end that is connected to the external electric current source and the other end that is connected to the motor control unit of the electric power source 9. The halfway section through the power feeding cable 12 in the length direction is held by an after-mentioned cable holding tool 17. The power feeding cable 12 is largely sectioned into an electric current source-side cable 12A disposed between the cable holding tool 17 and the external electric current source and into an electric power source-side cable 12B disposed between the cable holding tool 17 and the electric power source 9. Accordingly, the electric current source-side cable 12A of the power feeding cable 12 displaces in response to a traveling operation and a revolving operation of the hydraulic excavator 1. Part of the electric power source-side cable 12B is inserted in an after-mentioned cable insertion hole 16.

The counterweight 13 is disposed in a rear end of the revolving frame 5 and acts as a weight balance to the working mechanism 4. The counterweight 13 is composed of a block body formed in a quadrangular frame shape as a whole and is integrally formed by casting using a metallic material such as casting iron or casting steel. The counterweight 13 rises upward from the rear end of the revolving frame 5 in order to cover mount devices of the electric motor 10, the hydraulic pump 11 and the like from the rear side.

The counterweight 13 has a front surface 13A positioned in a machine room 8-side and a rear surface 13B positioned at the opposite side to the machine room 8, and acts as a rigid heavy object being set to be larger in thickness between the front surface 13A and the rear surface 13B. The rear surface 13B of the counterweight 13 is formed as a curved surface in a convex, arc shape in such a manner that a central part thereof in the left-right direction projects to the rear side. A top surface 13C of the counterweight 13 is formed as a flat surface extending horizontally and is flush with top surfaces of the left cover 7A and the right cover 7B of the housing cover 7. The counterweight 13 has the top surface 13C in which the cable insertion hole 16 is formed.

A quadrangular inspection opening 13D is disposed on the rear surface 13B of the counterweight 13. The inspection opening 13D is disposed in a central part of the counterweight 13 in the upper-lower direction and in the left-right direction. The inspection opening 13D penetrates through the counterweight 13 from the rear surface 13B to the front surface 13A thereof of in the front-rear direction. The inspection opening 13D is communicated with the machine room 8 surrounded by the housing cover 7 and the counterweight 13. Therefore, the inspection work to the electric power source 9 including the electric motor 10 and the like accommodated in the machine room 8 can be performed through the inspection opening 13D from the rear surface 13B-side of the counterweight 13.

Left and right link attaching seats 13E are arranged on an upper inner peripheral edge of the inspection opening 13D to face with each other in the left-right direction. Aftermentioned link mechanisms 15 are attached on the left and right link attaching seats 13E respectively. A plurality of additional weight attaching holes 13F are arranged on a section, which is lower than the inspection opening 13D, of the rear surface 13B of the counterweight for attaching additional weights (not shown) to the counterweight 13.

An opening/closing cover 14 is disposed on the rear surface 13B of the counterweight 13. The opening/closing cover 14 is formed in a quadrangular plate shape and covers the inspection opening 13D of the counterweight 13 so as to be openable/closable. The left and right link mechanisms 15 are arranged between the left and right link attaching seats 13E of the counterweight 13 and the opening/closing cover 14. The opening/closing cover 14 is supported by the left and right link mechanisms 15. The opening/closing cover 14 moves in the up and down direction between a closing position where the inspection opening 13D of the counterweight 13 is closed as shown in a solid line in FIG. 1 and an opening position where the inspection opening 13D of the counterweight 13 is opened as shown in a two-dot chain line in FIG. 1.

Figure 2:
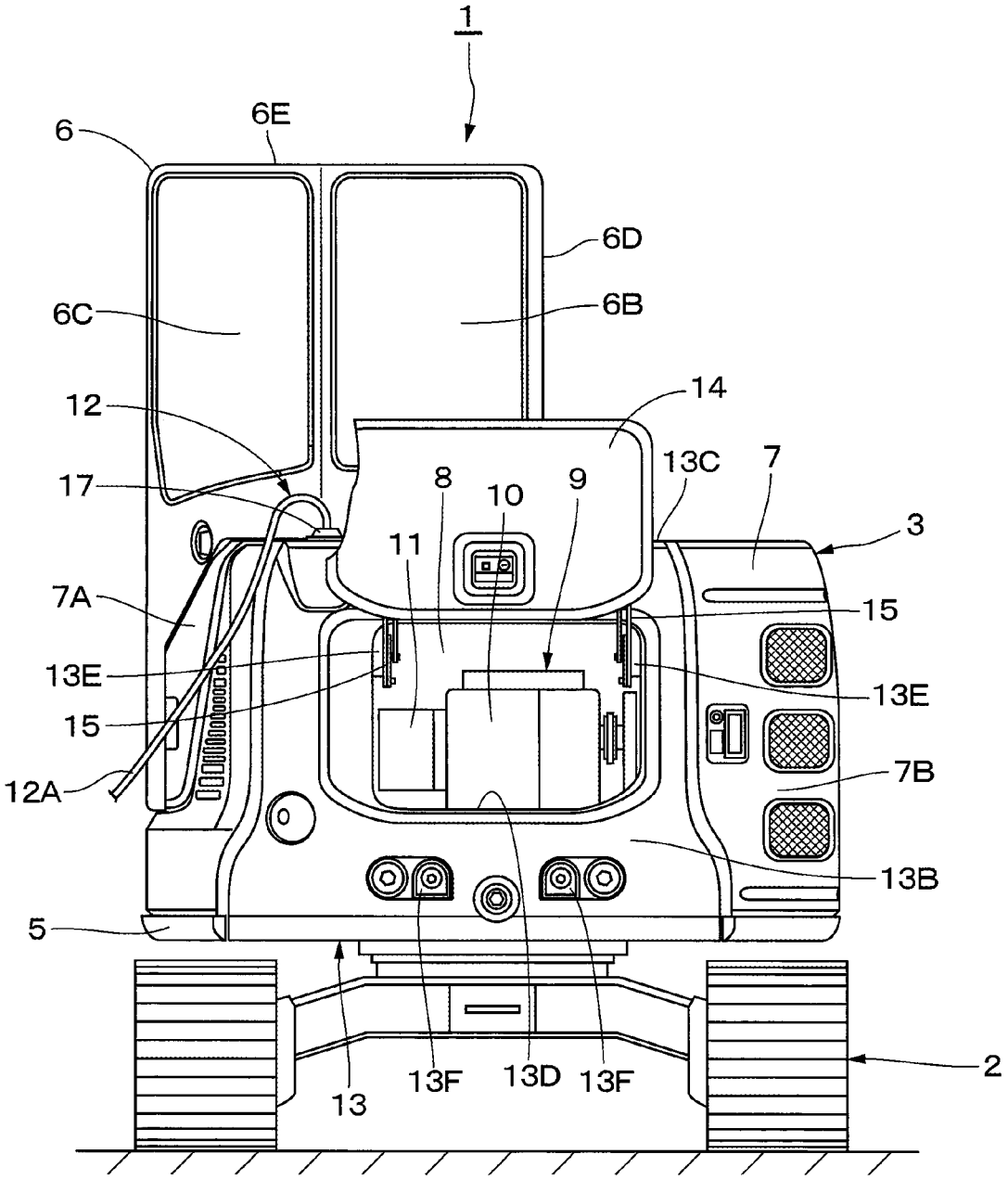
FIG. 2 is a back view showing the hydraulic excavator in which a working mechanism is removed, as viewed from backward.

Therefore, for performing the inspection work to the electric power source 9 and the like accommodated in the machine room 8, as shown in FIG. 2 the opening/closing cover 14 is caused to be moved to the opening position to open the inspection opening 13D of the counterweight 13. Thereby, an operator can have access to the electric power source 9 through the inspection opening 13D from the rear surface 13B-side of the counterweight 13.

Figure 4:
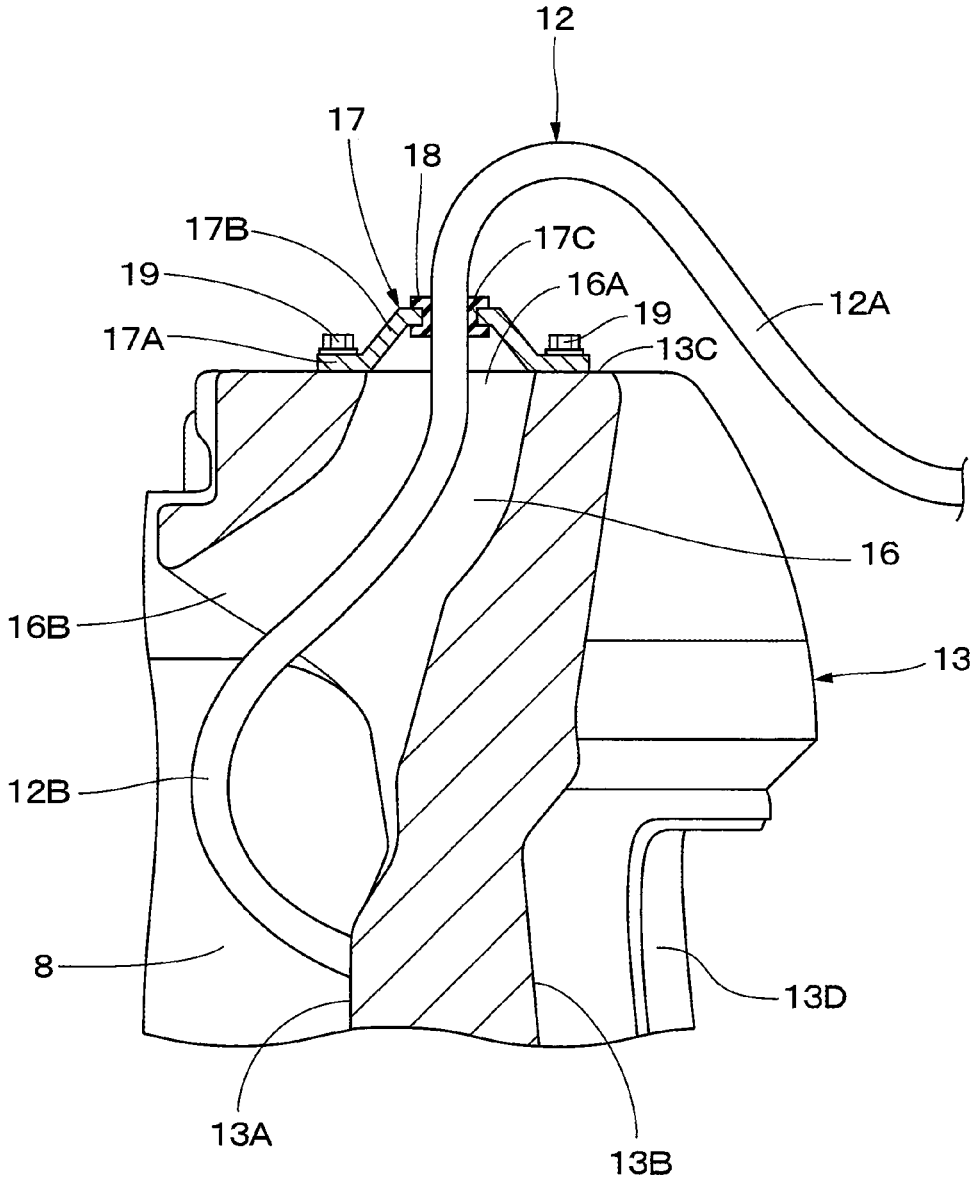
FIG. 4 is a cross section showing the counterweight, a cable insertion hole, the power feeding cable, and the like, as viewed in a direction of arrows IV-IV in FIG. 3.
Figure 5:
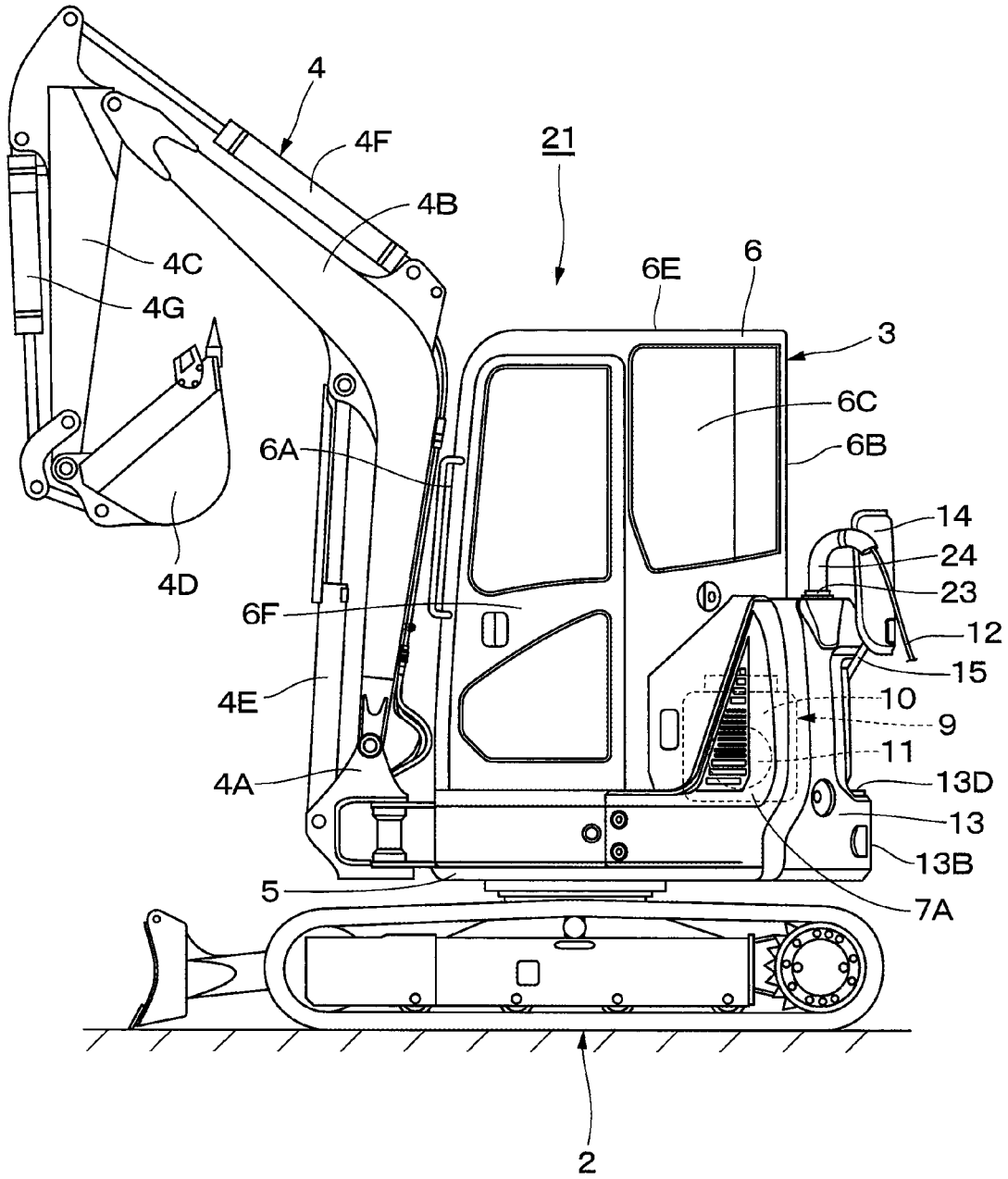
FIG. 5 is a front view showing an electric hydraulic excavator according to a second embodiment.
Figure 6:
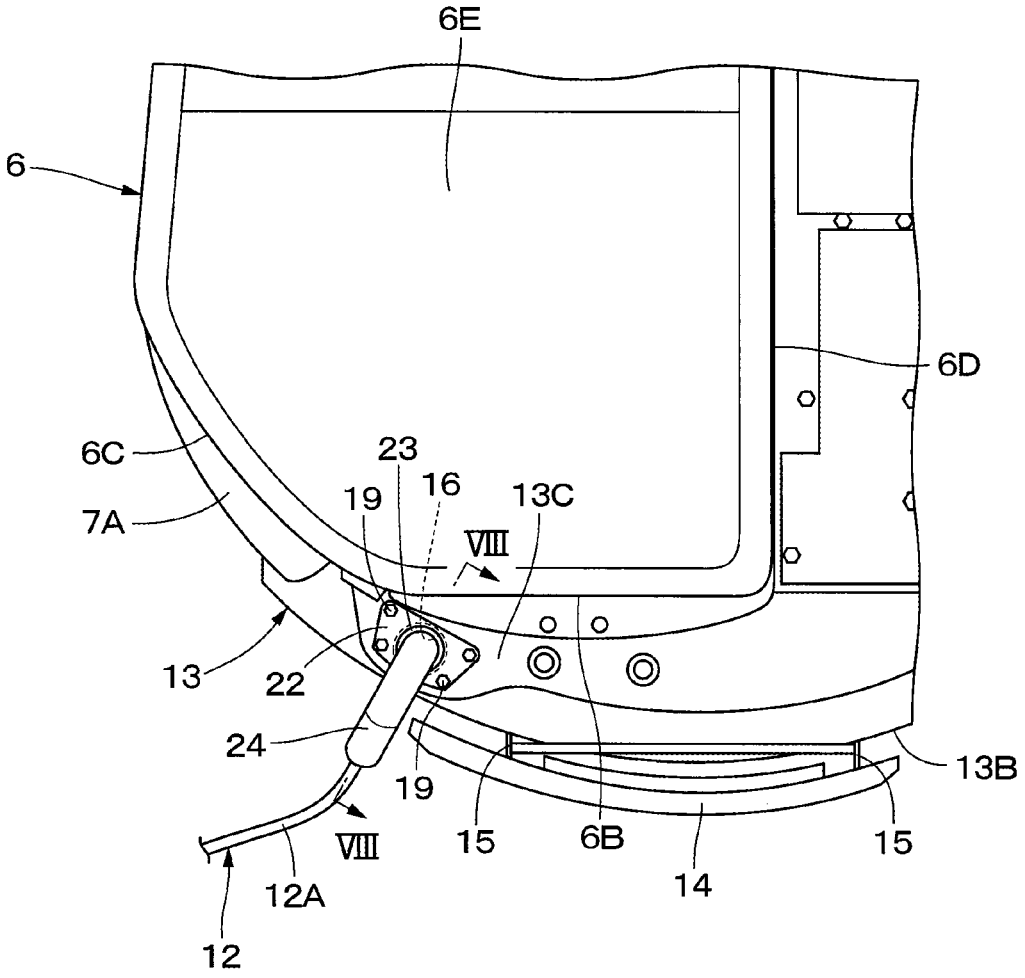
FIG. 6 is a plan view showing a cab, a counterweight, a power feeding cable, a guide pipe, and the like, as viewed from above.
Figure 7:
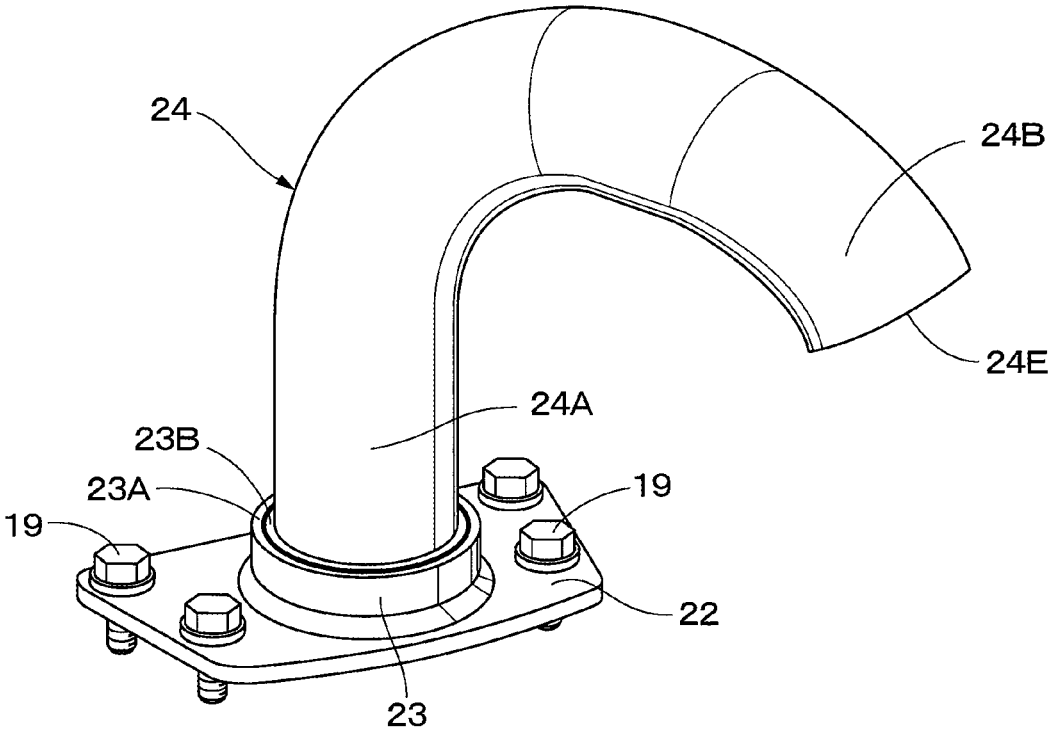
FIG. 7 is a perspective view showing an attaching base, a bearing, and the guide pipe.
Figure 8:
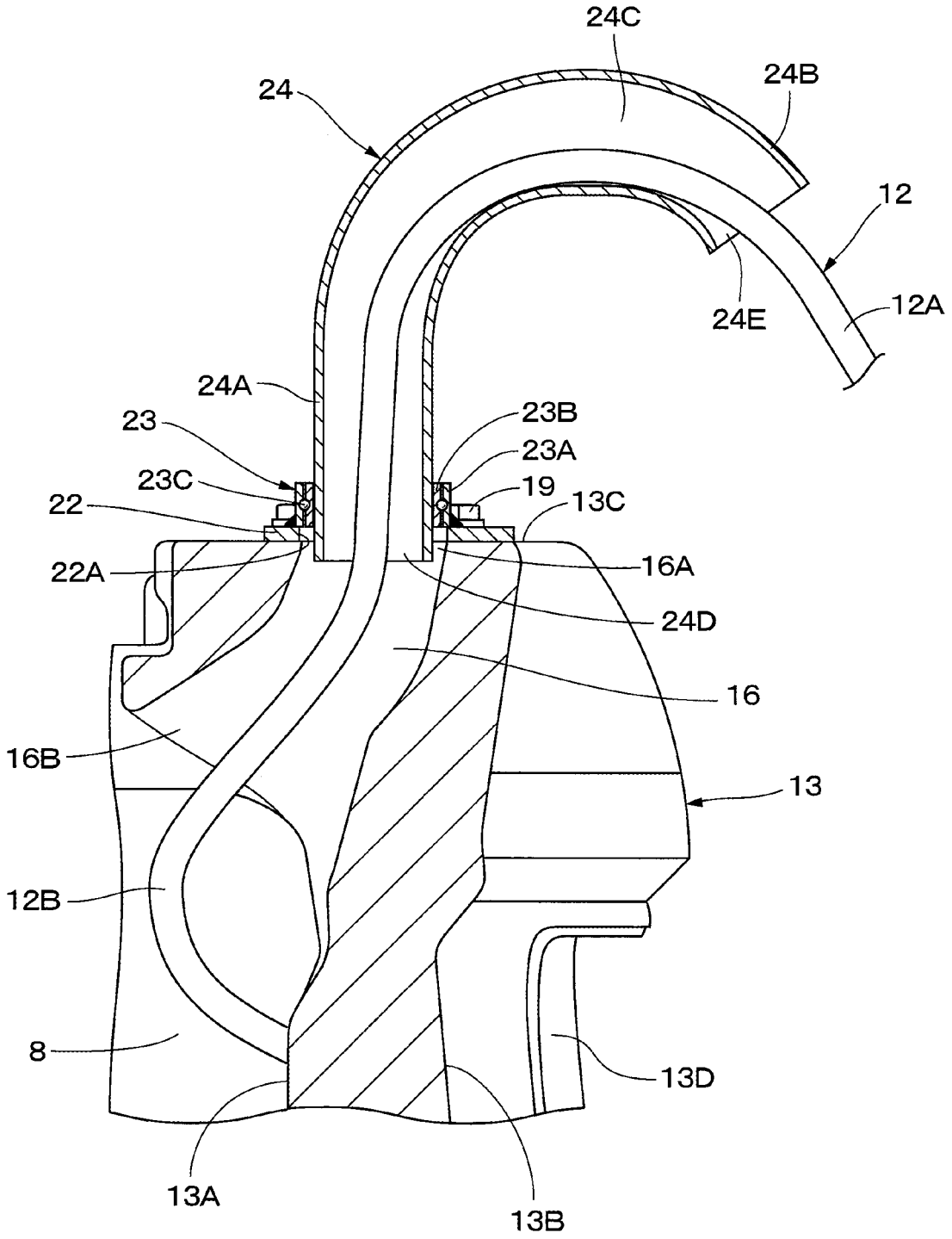
FIG. 8 is a cross section showing the counterweight, a cable insertion hole, the guide pipe, the power feeding cable, and the like, as viewed in a direction of arrows VIII-VIII in FIG. 6.

The cable insertion hole 16 is disposed in the counterweight 13 for insertion of the electric power source-side cable 12B of the power feeding cable 12. As shown in FIG. 4, the cable insertion hole 16 is disposed to be communicated between the top surface 13C and the front surface 13A and opens to the machine room 8 in a state of extending obliquely downward from the top surface 13C of the counterweight 13 toward the front surface 13A of the counterweight 13.

Figure 3:
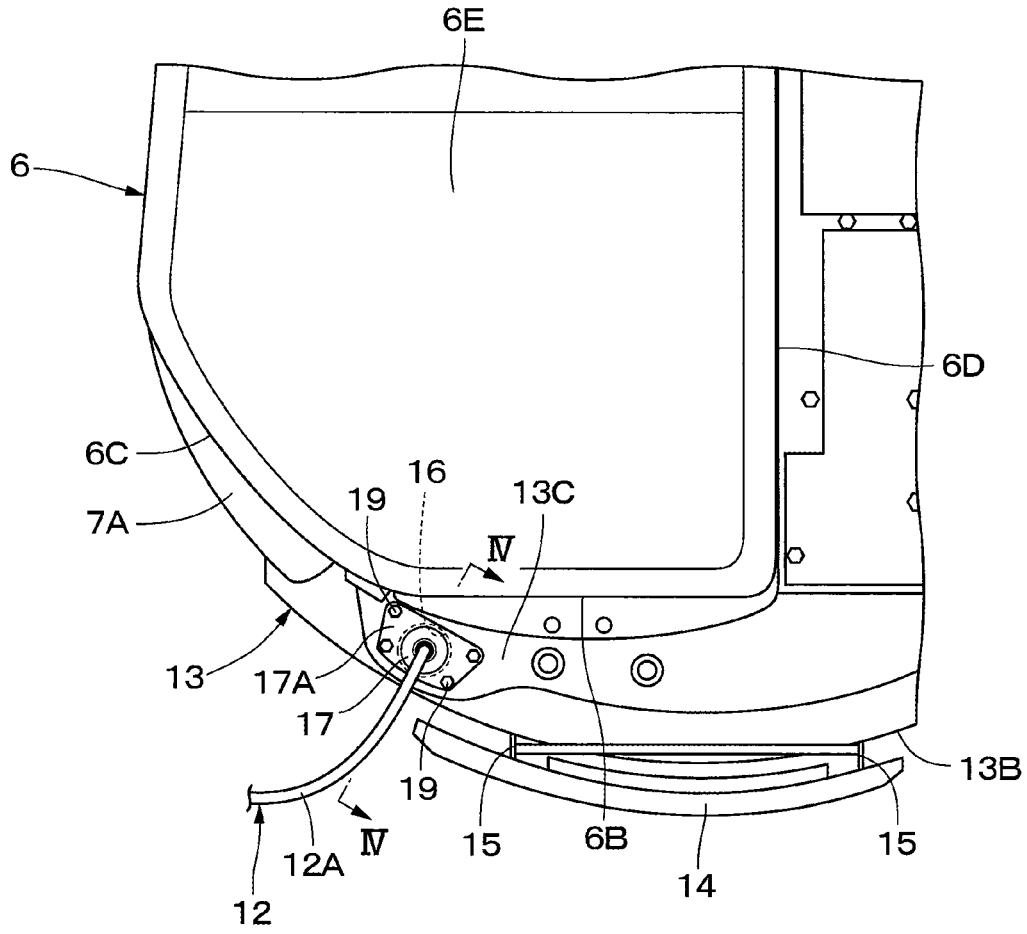
FIG. 3 is a plan view showing a cab, a counterweight, a power feeding cable, and the like, as viewed from above.

Here, as shown in FIG. 3, the cable insertion hole 16 is disposed behind the cab 6 (in back of the rear surface portion 6B of the cab 6) and in a position deviating from the opening/closing cover 14 (in a position of avoiding interference with the opening/closing cover 14) on the top surface 13C of the counterweight 13, that is, on a left end side of the counterweight 13. Thereby, it is possible to cause the power feeding cable 12 inserted into the cable insertion hole 16 to be positioned outside of a view range of an operator operating the hydraulic excavator 1 within the cab 6. In addition, at the time of opening/closing the opening/closing cover 14 between the closing position and the opening position, the power feeding cable 12 can be suppressed from interfering with the opening/closing cover 14.

The cable insertion hole 16 has an upper opening end 16A opened to the top surface 13C of the counterweight 13 and a lower opening end 16B opened to the front surface 13A of the counterweight 13. An opening area of the lower opening end 16B is formed larger than an opening area of the upper opening end 16A. That is, the cable insertion hole 16 is formed in a trumpet shape in which the opening area is gradually enlarged in diameter from the upper opening end 16A toward the lower opening end 16B in order that the opening area of the lower opening end 16B is larger than that of the upper opening end 16A. As a result, even in a case where a connector (not shown) for connection of the power feeding cable 12 to the electric power source 9 is attached to a tip end of the power feeding cable 12 (the electric power source-side cable 12B), the tip end of the power feeding cable 12 is configured to be able to smoothly come in and out of the machine room 8.

The cable holding tool 17 is disposed on the top surface 13C of the counterweight 13 and holds the halfway section of the power feeding cable 12 in the length direction. As shown in FIG. 4, the cable holding tool 17 has a plate-shaped attaching portion 17A and a holding portion 17B swollen in a circular truncated cone shape from the attaching portion 17A. A cable attaching hole 17C is formed in a center part of the holding portion 17B. A cylindrical grommet 18 made of elastic material of rubber or the like is attached on a peripheral edge portion of the cable attaching hole 17C in the cable holding tool 17.

The cable holding tool 17 holds the halfway section of the power feeding cable 12 through the grommet 18 within the cable attaching hole 17C. In this state, the attaching portion 17A of the cable holding tool 17 is fixed on the top surface 13C of the counterweight 13 using a plurality of (for example, four) bolts 19. Thereby, the halfway section of the power feeding cable 12 is held by the cable holding tool 17 fixed on the counterweight 13. In addition, the upper opening end 16A of the cable insertion hole 16 is sealed by (covered with) the cable holding tool 17.

In this way, the power feeding cable 12 for connection between the electric power source 9 mounted on the hydraulic excavator 1 and the external electric current source is inserted in the cable insertion hole 16 disposed in the counterweight 13 composed of the rigid heavy object. Thereby, it is possible to prevent the power feeding cable 12 from being damaged by the deformation and damage of the counterweight 13 and protect the power feeding cable 12 inserted in the cable insertion hole 16. On the other hand, the cable insertion hole 16 is disposed in the counterweight 13 made of metallic material. Therefore, it is possible to shield electrical noises generating from the power feeding cable 12 to the electric devices arranged within the machine room 8 by surrounding the power feeding cable 12 by the cable insertion hole 16.

The hydraulic excavator 1 according to the first embodiment has the configuration as described above, and hereinafter, an explanation will be made of an operation of the hydraulic excavator 1.

First, an operator gets in the cab 6 and starts the electric motor 10. Thereby, the electric power from the external electric current source is supplied (fed) through the power feeding cable 12 to the motor control unit of the electric power source 9. Caused by this, the electric motor 10 rotates to drive the hydraulic pump 11.

When the control lever unit for traveling disposed within the cab 6 is operated in this state, the hydraulic excavator 1 can travel forward or backward. In addition, when the control lever unit for working is operated, the hydraulic excavator 1 performs an excavating work of sand and earth or the like by the working mechanism 4 while revolving the upper revolving structure 3. At this time, the electric current source-side cable 12A of the power feeding cable 12 displaces in response to a traveling operation of the hydraulic excavator 1 or a revolving operation of the upper revolving structure 3.

In this case, the power feeding cable 12 for connection between the electric power source 9 and the external electric current source is inserted in the cable insertion hole 16 disposed in the counterweight 13 composed of the rigid heavy object. Thereby, when the counterweight 13 makes contact with the surrounding obstacle at the working of the hydraulic excavator 1 or even when the dropping object collides with the counterweight 13, the counterweight 13 can be prevented from being easily deformed. Therefore, it is possible to protect the power feeding cable 12 inserted in the cable insertion hole 16.

On the other hand, the halfway section of the power feeding cable 12 is surrounded by the cable insertion hole 16 disposed in the counterweight 13 made of metallic material. Therefore, it is possible to shield electrical noises generating from the power feeding cable 12 to the electric devices disposed within the machine room 8. As a result, the noises from the power feeding cable 12 can be suppressed from giving an adverse influence on various kinds of electric devices arranged within the machine room 8. Accordingly, it is not necessary to dispose a shielding member dedicated for shielding the noises generating from the power feeding cable 12, which can reduce an increase on the number of components to contribute also to a reduction in costs.

In this way, the electric construction machine 1 according to the first embodiment comprises the automotive lower traveling structure 2, and the upper revolving structure 3 mounted on the lower traveling structure 2 to be capable of revolving thereto, the upper revolving structure 3 including the revolving frame 5 as the base, the counterweight 13 disposed on the rear side of the revolving frame 5, and the electric power source 9 that is positioned on the front side of the counterweight 13 to be mounted on the revolving frame 5 and is power-fed from the external electric current source. In addition, the counterweight 13 is provided with the cable insertion hole 16 formed therein for insertion of the power feeding cable 12 for connection between the external electric current source and the electric power source 9.

According to this configuration, even in a case where the counterweight 13 makes contact with the surrounding obstacle or in a case where the dropping object collides with the counterweight 13, the counterweight 13 composed of the rigid heavy object is not easily deformed or damaged. As a result, it is possible to suppress the deformation or damage of the cable insertion hole 16 formed in the counterweight 13 to protect the power feeding cable 12 inserted in the cable insertion hole 16. Further, the halfway section of the power feeding cable 12 is surrounded by the cable insertion hole 16 disposed in the counterweight 13 made of metallic material. Therefore, it is possible to shield electrical noises generating from the power feeding cable 12 to the electric devices disposed within the machine room 8. As a result, the noises from the power feeding cable 12 can be suppressed from giving an adverse influence on various kinds of electric devices arranged within the machine room 8.

In the first embodiment, the cable insertion cable 16 is disposed to be communicated between the top surface 13C of the counterweight 13 and the front surface 13A of the counterweight 13. According to this configuration, it is possible to naturally extend the cable 12 from the external electric current source toward the electric power source 9 within the machine room 8 formed on the front side of the counterweight 13.

In the first embodiment, the cable insertion hole 16 is formed such that the opening area of the lower opening end 16B opened to the front surface 13A of the counterweight 13 is larger than that of the upper opening end 16A opened to the top surface 13C of the counterweight 13. In addition, the cable insertion hole 16 is formed such that the opening area is gradually enlarged in diameter toward the lower opening end 16B from the upper opening end 16A.

According to this configuration, even in a case where the connector for connection to the electric power source 9 is attached to the tip end of the power feeding cable 12 (the electric power source-side cable 12B), it is possible to cause the tip end of the power feeding cable 12 to smoothly come in and out of the machine room 8. Therefore, it is possible to enhance the workability at the time of connecting through the connector the power feeding cable 12 and the electric power source 9.

According to the first embodiment, the cab 6 as the operator's room is disposed in the revolving frame 5, the inspection opening 13D for inspecting the electric power source 9 and the opening/closing cover 14 for opening/closing the inspection opening 13D are arranged on the rear surface 13B of the counterweight 13. The cable insertion hole 16 is disposed behind the cab 6 and in the position deviating from the opening/closing cover 14.

According to this configuration, it is possible to cause the power feeding cable 12 inserted into the cable insertion hole 16 to be positioned outside of a view range of an operator operating the hydraulic excavator 1 within the cab 6. As a result, it is possible to secure a good view of the operator to enhance the operability of the hydraulic excavator 1. In addition, at the time of opening/closing the opening/closing cover 14 between the closing position and the opening position for performing the inspection work to the electric power source 9 accommodated within the machine room 8 of the upper revolving structure 3, the power feeding cable 12 can be suppressed from interfering with the opening/ closing cover 14. As a result, it is possible to enhance the workability of the inspection work to the electric power source 9.

Next, FIG. 5 to FIG. 8 show a second embodiment according to the present invention. The second embodiment is characterized in that a guide pipe is attached to be rotatable to a counterweight and a power feeding cable is guided through the guide pipe to a cable insertion hole. It should be noted that in the second embodiment, components identical to those in the first embodiment are referred to as identical reference numerals, and an explanation thereof is omitted.

In the figures, an electric hydraulic excavator 21 includes, as similar to the hydraulic excavator 1 according to the first embodiment, the lower traveling structure 2, the upper revolving structure 3 and the working mechanism 4. The upper revolving structure 3 includes the revolving frame 5, the cab 6, the housing cover 7 and the counterweight 13. The electric power source 9 accommodated within the machine room 8 and the external electric current source (not shown) are connected by the power feeding cable 12. In addition, the counterweight 13 is provided with the cable insertion hole 16 that is communicated with the machine room 8 and in which the power feeding cable 12 is inserted. However, the hydraulic excavator 21 according to the second embodiment differs in a point where an after-mentioned guide pipe 24 is attached to the counterweight 13, from the hydraulic excavator 1 according to the first embodiment.

An attaching base 22 is fixed on a section, in which the upper opening end 16A of the cable insertion hole 16 is formed, of the top surface 13C of the counterweight 13. The attaching base 22 is formed in a quadrangular plate shape. A pipe insertion hole 22A is formed in the center part of the attaching base 22 to penetrate therethrough in the upper-lower direction. The attaching base 22 is fixed on the top surface 13C of the counterweight 13 using a plurality of bolts 19 in a state where an after-mentioned bearing 23 is attached on the top surface of the attaching base 22.

The bearing 23 is attached through the attaching base 22 on the top surface 13C of the counterweight 13 to support the guide pipe 24 to be rotatable to the counterweight 13. The bearing 23 includes an outer race 23A and an inner race 23B, and a plurality of rolling elements 23C. The outer race 23A is fixed on the top surface of the attaching base 22 by means, such as welding. The inner race 23B is disposed on an inner peripheral side of the outer race 23A. The plurality of rolling elements 23C hold the inner race 23B to be rotatable to the outer race 23A. A linear portion 24A of the guide pipe 24 is inserted in the inner race 23B of the bearing 23.

The guide pipe 24 is attached on the top surface 13C of the counterweight 13 to be rotatable thereto through the bearing 23. The guide pipe 24 guides the power feeding cable 12 to the cable insertion hole 16 of the counterweight 13. Here, the guide pipe 24 is formed by a metallic pipe in a J letter shape having the linear portion 24A extending in a perpendicular direction and a bent portion 24B bent downward from a top end of the linear portion 24A. An inner peripheral side of the guide pipe 24 is formed as a hollow portion 24C communicating with the cable insertion hole 16.

A lower end of the linear portion 24A in the guide pipe 24 is inserted in the inner race 23B of the bearing 23 for fixation. A lower opening end 24D of the guide pipe 24 opens through the pipe insertion hole 22A of the attaching base 22 into the cable insertion hole 16. The linear portion 24A of the guide pipe 24 rises perpendicularly upward from the top surface 13C of the counterweight 13. The bent portion 24B of the guide pipe 24 is bent in a reverse-J letter shape from the top surface 13C of the counterweight 13. An upper opening end 24E of the bent portion 24B opens downward to prevent rainwater or the like from penetrating through the guide pipe 24 into the machine room 8.

The power feeding cable 12 is inserted into the hollow portion 24C of the guide pipe 24. The halfway portion of the power feeding cable 12 is held by the bent portion 24B of the guide pipe 24. As a result, the power feeding cable 12 is largely sectioned into the electric current source-side cable 12A and the electric power source-side cable 12B. The electric current source-side cable 12A is disposed between the guide pipe 24 and the external electric current source. The electric power source-side cable 12B is disposed between the guide pipe 24 and the electric power source 9 in the machine room 8.

The electric current source-side cable 12A of the power feeding cable 12 rotates to the counterweight 13 together with the guide pipe 24 supported by the bearing 23. Accordingly, the electric current source-side cable 12A can smoothly displace in response to the traveling operation of the hydraulic excavator 1 and the revolving operation of the upper revolving structure 3. In addition, the section, which is close to the counterweight 13, of the electric current source-side cable 12A is held by the bent portion 24B of the guide pipe 24. Therefore, even in a case where the electric current source-side cable 12A is loosened, it is possible to suppress the electric current source-side cable 12A from making contact with the counterweight 13 and the like.

The hydraulic excavator 21 according to the second embodiment has the guide pipe 24 as described above, and the hydraulic excavator 21 can also obtain an operational effect as similar to that of the first embodiment.

However, in the hydraulic excavator 21 according to the second embodiment, the guide pipe 24 is attached to be rotatable through the bearing 23 to the top surface 13C of the counterweight 13. In addition, the power feeding cable 12 is guided through the hollow portion 24C of the guide pipe 24 to the cable insertion hole 16 of the counterweight 13.

Thereby, the electric current source-side cable 12A of the power feeding cable 12 can rotate to the counterweight 13 together with the guide pipe 24. The electric current source-side cable 12A can easily displace in response to the traveling operation of the hydraulic excavator 1 and the revolving operation of the upper revolving structure 3. Further, the section, which is close to the counterweight 13, of the electric current source-side cable 12A is supported by the bent portion 24B of the guide pipe 24. Therefore, even in a case where the electric current source-side cable 12A is loosened, it is possible to suppress the electric current source-side cable 12A from making contact with the counterweight 13 and the like. Thereby, it is possible to extend a lifetime of the power feeding cable 12.

It should be noted that the embodiment shows an example in which the electric power source 9 connected through the power feeding cable 12 to the external electric current source includes the electric motor 10 and the motor control unit controlling the operation of the electric motor 10. However, the present invention is not limited thereto, but, for example, an electric power source may be configured to include an electric motor, a battery reserving electric power to be supplied to the electric motor, and a charger charging the battery, and the power feeding cable 12 may be connected to the charger of the electric power source.

In addition, the embodiment shows an example in which the opening/closing cover 14 is disposed on the rear surface 13B of the counterweight 13 to open/close in the upper-lower direction between the opening position for opening the inspection opening 13D and the closed position for closing the inspection opening 13D. However, the present invention is not limited thereto, but, for example, there may be disposed an opening/closing cover that has one end in the left-right direction attached through a hinge mechanism to a counterweight and is opened/closed in the left-right direction about the hinge mechanism.

DESCRIPTION OF REFERENCE NUMERALS

1, 21: HYDRAULIC EXCAVATOR (CONSTRUCTION MACHINE)
2: LOWER TRAVELING STRUCTURE
3: UPPER REVOLVING STRUCTURE
5: REVOLVING FRAME
6: CAB (OPERATOR'S ROOM)
9: ELECTRIC POWER SOURCE
12: POWER FEEDING CABLE
13: COUNTERWEIGHT
13B: REAR SURFACE
13D: INSPECTION OPENING
14: OPENING/CLOSING COVER
16: CABLE INSERTION HOLE
24: GUIDE PIPE
24C: HOLLOW PORTION

The invention claimed is:

1. An electric construction machine comprising:

an automotive lower traveling structure; and an upper revolving structure mounted on the lower traveling structure to be capable of revolving thereto, the upper revolving structure including a revolving frame as a base, an operator's room disposed in a front left side of the revolving frame, a counterweight disposed on a rear side of the revolving frame, and an electric power source that is positioned on a front side of the counterweight to be mounted on the revolving frame and is power-fed from an external electric current source, wherein the counterweight is formed of metallic material, a top surface of the counterweight is provided with a cable insertion hole formed therein for insertion of a power feeding cable for connection between the external electric current source and the electric power source, and the cable insertion hole is disposed on the top surface of the counterweight behind the operator's room and on a left side of the counterweight.

2. The electric construction machine according to claim 1, wherein the cable insertion hole is disposed to be communicated between a top surface of the counterweight and a front surface of the counterweight, and a front surface side of the counterweight of the cable insertion hole is opened to a machine room where the electric power source is accommodated.

3. The electric construction machine according to claim 2, wherein the cable insertion hole is formed such that an opening area of a lower opening end thereof opened to the front surface of the counterweight is larger than that of an upper opening end thereof opened to the top surface of the counterweight.

4. The electric construction machine according to claim 2, wherein the counterweight has a rear surface on which an inspection opening for inspecting the electric power source accommodated in the machine room and an opening/closing cover for opening/closing the inspection opening are disposed, the inspection opening penetrates from the rear surface of the counterweight to the front surface of the counterweight and is communicated with the machine room, and the cable insertion hole is disposed separately from the inspection opening and is disposed behind the operator's room and on the left side of the counterweight separate from the opening/closing cover.

5. The electric construction machine according to claim 1, wherein the counterweight is provided with a guide pipe that is attached to be rotatable to the counterweight, the guide pipe having a hollow portion communicated with the cable insertion hole, and the power feeding cable is guided through the guide pipe to the cable insertion hole.

6. The electric construction machine according to claim 1, wherein a cable holding tool is disposed on the top surface of the counterweight for holding the power feeding cable, and the cable holding tool seals the opening of the cable insertion hole on the top surface side of the counterweight.

* * * * *